US011692383B2

(12) United States Patent
Culp et al.

(10) Patent No.: US 11,692,383 B2
(45) Date of Patent: Jul. 4, 2023

(54) HINGE ASSEMBLY FOR ELEVATIONAL RAILS

(71) Applicant: eGlass, LLC, Vancouver, WA (US)

(72) Inventors: Jeremiah D. Culp, Vancouver, WA (US); Eric W. Reimer, Camas, WA (US)

(73) Assignee: eGlass, LLC, Vancouver, WA (US)

( * ) Notice: Subject to any disclaimer, the term of this patent is extended or adjusted under 35 U.S.C. 154(b) by 944 days.

(21) Appl. No.: 16/455,516

(22) Filed: Jun. 27, 2019

(65) Prior Publication Data

US 2020/0032565 A1 Jan. 30, 2020

Related U.S. Application Data

(60) Provisional application No. 62/702,553, filed on Jul. 24, 2018.

(51) Int. Cl.

| | |
|---|---|
| ***E05D 7/00*** | (2006.01) |
| ***E05D 15/00*** | (2006.01) |
| ***E05D 5/02*** | (2006.01) |
| ***E04F 11/18*** | (2006.01) |
| *E05D 3/02* | (2006.01) |

(52) U.S. Cl.

CPC ..... *E05D 7/0009* (2013.01); *E04F 11/1836* (2013.01); *E05D 5/0238* (2013.01); *E05D 15/00* (2013.01); *E05D 3/02* (2013.01); *E05Y 2900/10* (2013.01)

(58) Field of Classification Search

CPC ..... E04F 11/1834; E04F 11/1836; E04H 17/1445; E04H 17/1448; E05D 7/009; E05D 15/00; E05D 3/02; E05D 5/06; E05D 5/023; E05D 5/0238; E05D 5/121; E05D 2005/122; E05Y 2900/10; Y10T 16/5323

USPC ..... 256/67, 65.02; 16/239

See application file for complete search history.

(56) References Cited

U.S. PATENT DOCUMENTS

| | | | | |
|---|---|---|---|---|
| 2,715,513 A * | 8/1955 | Kools | E04F 11/1834 | D25/42 |
| 3,648,982 A * | 3/1972 | Sabel | E04F 11/1834 | 256/22 |
| 4,150,907 A * | 4/1979 | Thurnauer | F16B 12/40 | 403/191 |
| 5,026,028 A * | 6/1991 | Ooi | E04F 11/1834 | 248/291.1 |
| 7,077,386 B1 * | 7/2006 | Gray, Jr. | E04F 11/1834 | 256/65.03 |
| 9,322,180 B2 * | 4/2016 | Burt | E04H 17/14 | |

(Continued)

*Primary Examiner* — William L Miller

(74) *Attorney, Agent, or Firm* — Seed Intellectual Property Law Group LLP

(57) ABSTRACT

An articulated attachment assembly and a rail system and method of installation for rail installations in which there is an elevational change between vertical supports, in which the articulated attachment assembly eliminates the need for field mitering of components and provides instead a first articulated hinge assembly having a first mounting block to be attached to the first support, a second mounting block to be attached to the first rail connection block, and a hinge member to couple the second mounting block to the first mounting block and enable the second mounting block, the first rail connection block, and the rail to pivot together relative to the first mounting block and the first support.

12 Claims, 7 Drawing Sheets

(56) References Cited

U.S. PATENT DOCUMENTS

| | | | | |
|---|---|---|---|---|
| 10,513,854 | B2 * | 12/2019 | Timmons | E04F 11/1844 |
| 11,136,764 | B2 * | 10/2021 | Leary | E04F 11/1834 |
| 11,299,921 | B2 * | 4/2022 | Gurusamy | E05D 7/12 |
| 11,346,110 | B2 * | 5/2022 | Timmons | E04F 11/1844 |
| 2002/0172545 | A1 * | 11/2002 | Greaves | E04F 11/1834<br>403/67 |
| 2006/0033093 | A1 * | 2/2006 | Lo | E04H 17/1447<br>256/65.02 |
| 2006/0278471 | A1 * | 12/2006 | Petta | E04F 11/1834<br>182/106 |
| 2007/0080333 | A1 * | 4/2007 | Perry | E04H 17/1413<br>256/67 |
| 2009/0179183 | A1 * | 7/2009 | Ferris | E04F 11/1817<br>256/67 |
| 2010/0091494 | A1 * | 4/2010 | Pearson | F21V 21/22<br>362/249.02 |
| 2018/0266119 | A1 * | 9/2018 | Schneider | E04F 11/1836 |
| 2019/0119924 | A1 * | 4/2019 | Timmons | E04F 11/1834 |

* cited by examiner

HINGE ASSEMBLY FOR ELEVATIONAL RAILS

BACKGROUND

Technical Field

The present disclosure pertains to attaching rails to support structures and, more particularly, to components for rails having varied elevational changes between support structures in which the attachment hardware is adjustable and hidden from view.

Description of the Related Art

Rails, which includes bottom rails, top rails, and railings (also known as top hand rails), are utilized in a variety of applications, including elevated porches and decks, around swimming pools, and along stairways. The rail structure typically can include a top hand rail or railing and upright or vertical supports that hold the railing above the ground or to a structure, such as a wall or deck. In installations employing a barrier between the vertical uprights, a bottom rail is utilized to support the barrier in combination with the top rail or top hand rail. The connections between the rails and the vertical supports are often done with fasteners such as screws, rivets, or bolts.

It is often necessary to install bottom rails, top rails, and railings at an angle to the vertical support to accommodate a change in elevation, such as on a stairway or sloped walkway. In such installations, it is desirable to use a rail connection block as the interface between the railing and the vertical support. When a rail is installed in the field, it is necessary to miter the end of the rail connection block so that it meets the vertical support with a flush abutment while angling away from the vertical support.

Mitering rail connection blocks in the field is undesirable because it is time-consuming, labor intensive, and requires access to the proper tools and equipment. Experience has shown that securing the rail connection block during cutting operations in the field is difficult and results in dangerous safety issues for installers. Having an adequate vise or other similar clamping apparatus would address the issue but is not desirable or feasible due to the costs in labor, time, and equipment.

BRIEF SUMMARY

The present disclosure is directed to an articulated attachment assembly for rail installations involving an elevational change between the supports, and is further directed to a rail system, and method of installation.

In accordance with one aspect of the present disclosure, an articulated attachment assembly for rail installations involving an elevational change between supports is provided. The articulated attachment assembly eliminates the need for field mitering of components and provides instead a first articulated hinge assembly having a first mounting block to be attached to the first support, a second mounting block to be attached to the first rail connection block, and a hinge member to couple the second mounting block to the first mounting block and enable the second mounting block, the first rail connection block, and the rail to pivot together relative to the first mounting block and the first support.

In accordance with a further aspect of the present disclosure, a railing system is provided that includes a first support and a second support, a rail having a first end and a second end, a first rail connection block sized and shaped to be attached to the first end of the rail, and a first articulated hinge assembly that itself includes a first mounting block to be attached to the first support, a second mounting block to be attached to the first rail connection block, and a hinge member to couple the second mounting block to the first mounting block and enable the second mounting block, the first rail connection block, and the rail to pivot together relative to the first mounting block and the first support. The system further includes a second rail connection block sized and shaped to be attached to the second end of the rail, and a second articulated hinge assembly that itself includes a first mounting block to be attached to the second support, a second mounting block to be attached to the second rail connection block, and a hinge member to couple the second mounting block to the first mounting block and enable the second mounting block, the second rail connection block, and the rail to pivot together relative to the second support.

In accordance with a further aspect of the present disclosure, the first and second articulated hinge assemblies enable the rail to pivot relative to the respective first support and the second support in the range of 29 degrees to 38 degrees.

In accordance with still yet another aspect of the present disclosure, a glass panel having a bottom edge and an opposing top edge is included as a barrier. The system further includes a top rail infill capable of attachment to the bottom side of the top rail, the top rail infill having a channel, and a first vinyl liner sized and shaped to be received in the channel of the top rail infill and further sized and shaped to receive the top edge of the glass panel.

In accordance with another aspect of the present disclosure, a bottom rail is provided along with two articulated hinge assemblies to attach the rail to the first and second supports.

In accordance with a further aspect of the present disclosure, a bottom rail infill is provide that is capable of attachment to the channel in the top side of the bottom rail, the bottom rail infill having a channel, and a second vinyl liner is provided that is sized and shaped to be received in the channel of the bottom rail infill and sized and shaped to receive the bottom edge of the glass panel.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
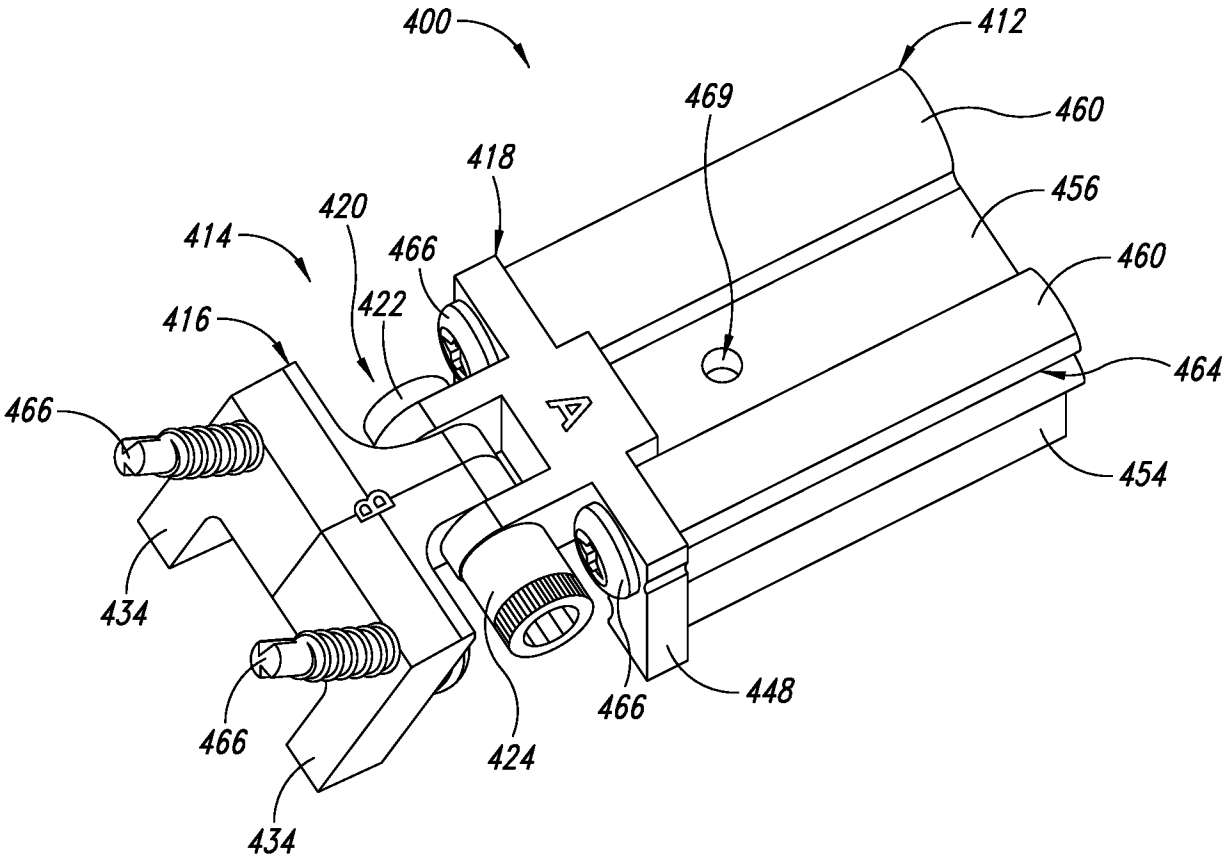
FIG. 1 is an isometric view of a rail mounting apparatus having an articulated hinge assembly formed in accordance with the present disclosure.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with extruded posts, top and bottom rails, railings, inserts, panels of glass, and fasteners or other materials and the like have not been shown or described in order to avoid unnecessarily obscuring descriptions of the various implementations of the present disclosure.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

The figures are provided (a) to further describe representative implementations of the present disclosure, (b) to show certain implementations or permutations of the present disclosure, and (c) to show enablement, function, and use thereof. In the detailed description of the figures that follows, like elements may be referred to with the same reference number throughout the different implementations of the present disclosure.

As used herein, the term rail is intended to embrace and mean, without limitation, a bottom rail, a top rail, and a top hand rail (also referred to as a railing). Rails may be a single piece, such as wood, plastic, metal (ferrous and non-ferrous), and may be formed using a variety of processes known in the art, such as extrusion. Rails may also include guardrails along platforms, walkways, stairs, stages, balconies, roadways, walkways, trails, and the like. Rail installations may be free-standing, meaning they include their own vertical support as an integral part of the rail installation. In the present disclosure, the term rail is intended to be applied to rails that are supported by a separate support or supporting structure, such as a post, a wall, spindle, picket, baluster, banister, balustrade, or even a natural structure, such as a tree or a rock wall, to which the rail must be attached either before or at the time of installation of the railing system. Moreover, a "railing," "railing system," and "rail system" can be considered a single rail between two supports, a plurality of rails, and even a fence or barrier in which one or more panels, bars, and other components (e.g., balusters, spindles, pickets, balustrades, lattices) cooperate with the rails to form a barrier that is either opaque, translucent, or transparent.

A representative implementation described herein utilizes extruded rails, either of plastic or metal. However, it is to be understood that the present disclosure can be adapted for use with other forms of rails, including without limitation those described and referred to herein.

Figure 2:
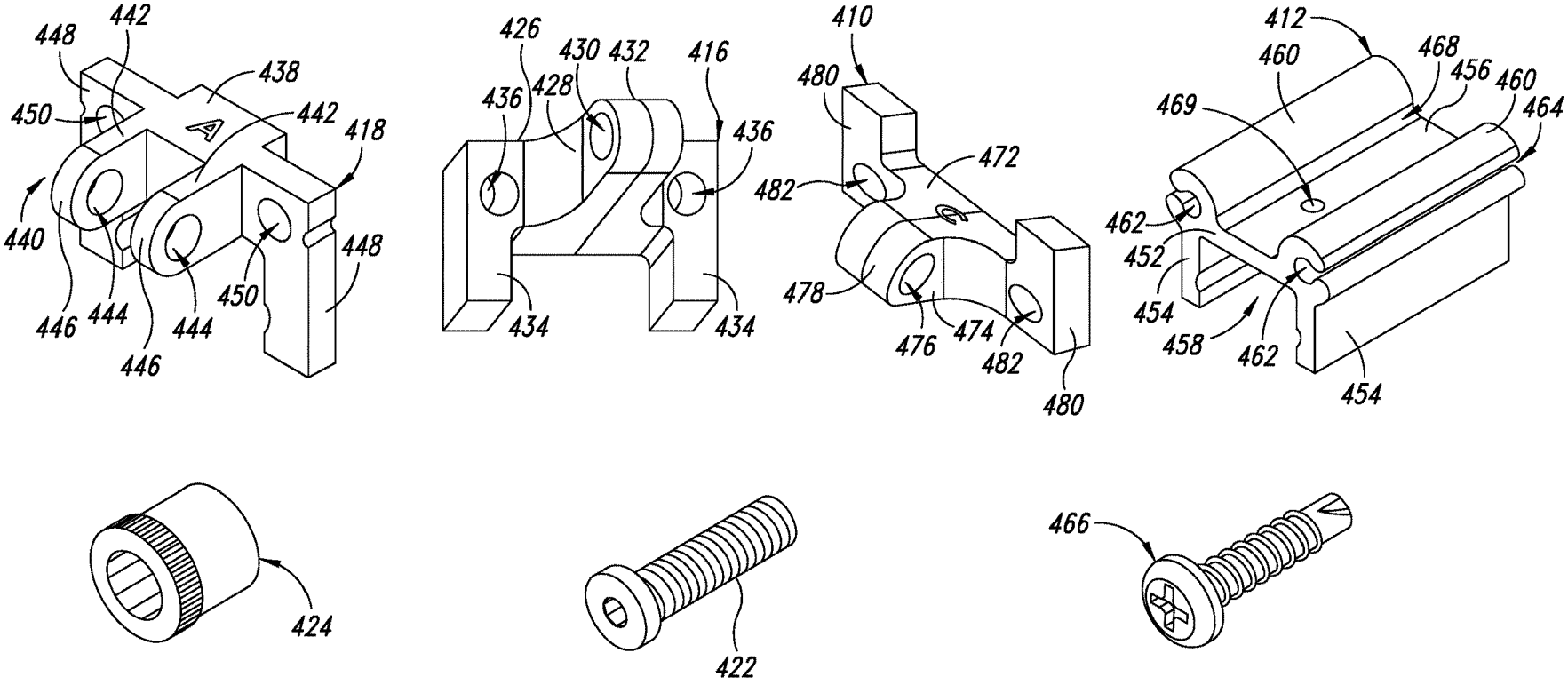
FIG. 2 is an isometric view of the rail mounting apparatus of FIG. 1 along with an additional mounting block to enable installation of top and bottom rails to first and second support posts having an elevational change.
Figures 10A, 10B, 10C, 10D, 10E:
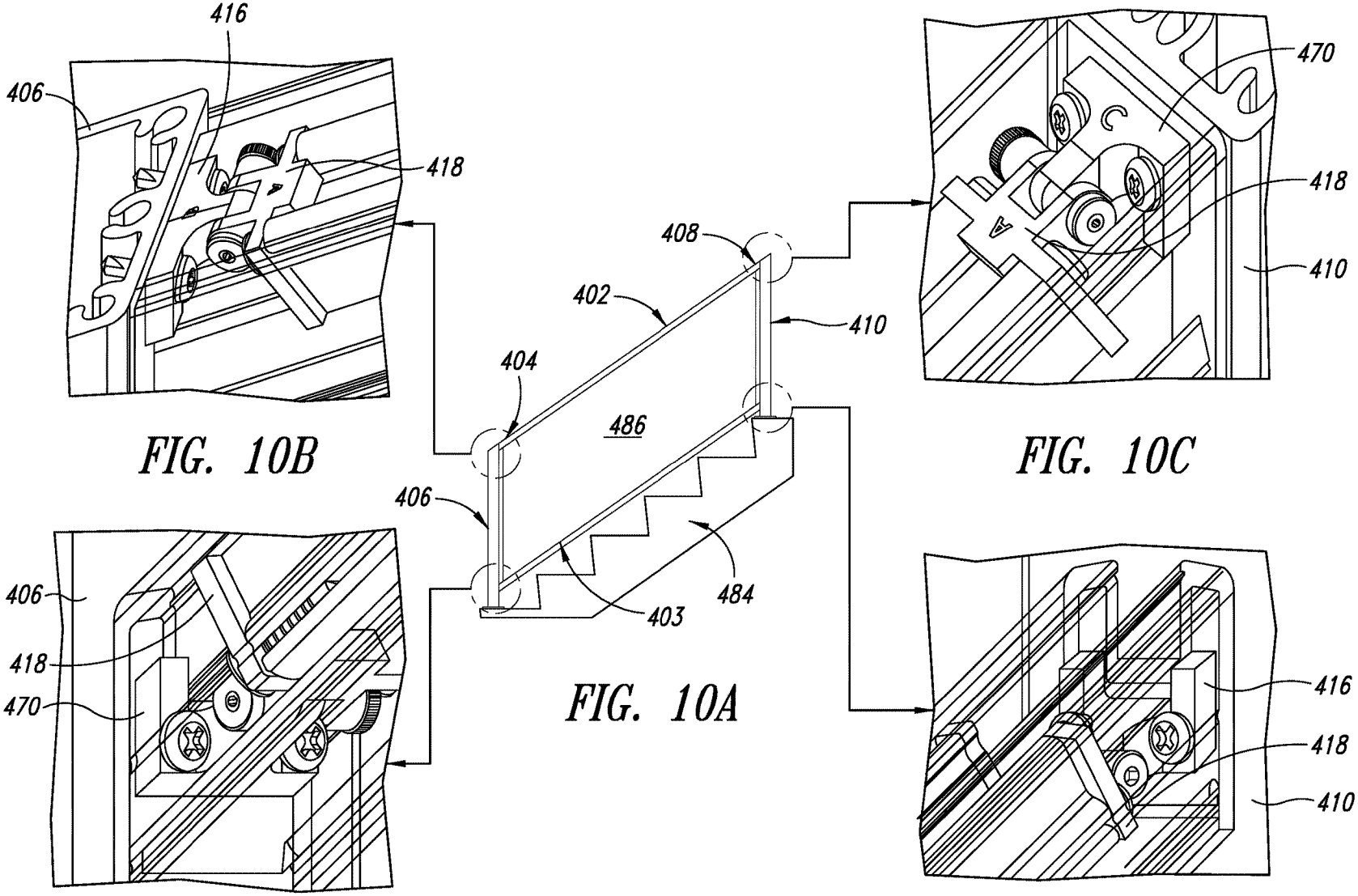
FIGS. 10A-10E are pictorial views of an installed rail system having an elevational change that employs a glass panel mounted between lower and upper support posts and top and bottom rails in accordance with a representative implementation of the present disclosure.

Referring initially to FIGS. 1 and 2, shown therein is a representative implementation of a rail mounting apparatus 400 for use with a top rail 402 and bottom rail 403 (shown in FIG. 10A) having a first end 404 to be attached to a first support, in this implementation a lower post 406, and a second end 408 to be attached to a second support, in this implementation an upper post 410. The rail mounting apparatus 400 includes a first rail connection block 412 sized and shaped to be attached to the first end 404 of the top rail 402, and a first articulated hinge assembly 414. The articulated hinge assembly 414 includes a first mounting block 416 (Block B) to be attached to the lower post 406, a second mounting block 418 (Block A) to be attached to the first rail connection block 412, and a hinge member in the form of a hinge pin 420 to couple the second mounting block 418 to the first mounting block 416 and enable the second mounting block 418, the first rail connection block 412, and the rail 402 to pivot together relative to the first mounting block 416 and the lower post 406.

In this representative implementation of the mounting apparatus 400, the hinge pin 420 consists of an externally threaded socket head screw 422 and an internally threaded socket nut 424. It is to be understood that a wide variety of hinge pins or axles can be employed to retain the first and second mounting blocks 416, 418 in rotational engagement.

The first mounting block 416 is a single unitary piece having a body 426 with central neck 428 extending therefrom with a lateral axial bore 430 extending through a distal end 432. A pair of parallel legs 434 extend from two opposing ends of the body 426 in a same direction that is substantially orthogonal to the neck 428. Two parallel, smooth bore openings 436 are formed in the opposing ends of the body 426 where it joins with the legs 434.

The second mounting block 418 is likewise a single unitary piece having a body 438 with a yoke 440 formed by two parallel arms 442 extending from the body 438. Each arm 442 has a lateral axial bore 444 formed through a distal end 446 thereof. A pair of parallel legs 448 extend from two opposing ends of the body 438 in a same direction that is substantially orthogonal to the yoke 440. Two parallel, smooth bore openings 450 are formed in the opposing ends of the body 438 where it joins with the legs 448.

The first mounting block 416 is coupled to the second mounting block 418 by placing the neck 428 of the first mounting block 416 in the yoke 440 of the second mounting block 418. When properly positioned, the lateral axial bore 430 of the first mounting block 416 will be co-axial with the lateral axial bore 444 of the second mounting block 418. The socket head screw 422 is then inserted through the lateral axial bore 444 of the yoke 440 and the bore 430 of the neck 428 and secured in place with the threaded socket nut 424. It is to be understood that other hinge designs may be used to couple the first and second mounting blocks 416, 418 together, such as free fit hinges, friction fit hinges, spring hinges, continuous hinges, and the like.

The rail connection block 412 is preferably a solid, unitary piece, preferably formed of extruded metal or plastic. It has a substantially U-shaped body 452 with a pair of mutually parallel legs 454 extending in a same direction from a cross piece 456 to form a bottom channel 458. The corners 460 where the legs 454 meet the cross piece 456 have an elongate cylindrical shape with a smooth longitudinal axial bore 462. A longitudinal expansion slot 464 is formed along the length of each cylindrical corner to permit a self-tapping threaded fastener 466 to enter the bore 456 and provide resilient expansion of the bore and avoid fracturing of the cylindrical corner 460. In addition, the cylindrical corners have a diameter that extends the corner 460 above a top surface of the cross piece 456 to create an upper channel 468. An opening 469 is formed in the cross piece 456 to enable a threaded fastener to pass through the cross piece and attach an additional component to the cross piece 456, which is described in more detail herein below.

Referring to FIG. 1, shown therein is the second block 418 (Block A) is positioned with the legs 448 against the legs 454 of the rail connection block 412 and the openings 450 in axial alignment with the openings 462. The second block 418 is attached to the rail connection block 412 with two fasteners 466 passing through the openings 450 in the second mounting block and into the openings 462 of the rail connection block 412 in a self-tapping fashion. It is to be understood that one or both of the openings 450 and 462 may be threaded and machine screws used, which is a matter of design choice and cost.

The first block 416 (Block B) is then attached to the second block 418 with the hinge pin 420 as described above. The legs 434 of the first block 416 should extend in substantially the same direction as the legs 448 of the second connection block 416 and the legs 454 of the rail connection block 412. This completes the assembly of the rail mounting apparatus 400 having the first block 416 that will be used for a top rail or railing installations having an upward elevation change, as described more fully below.

For bottom rail upward elevation change rail installations, a mounting block 470 (Block C) is used instead of the first mounting block 416 (Block B). The third mounting block 470 is a single unitary piece having a body 472 with central neck 474 extending therefrom with a lateral axial bore 476 extending through a distal end 478. A pair of parallel legs 480 extend from two opposing ends of the body 472 in a same direction that is substantially orthogonal to the neck 474. Two parallel, smooth bore openings 482 are formed in the opposing ends of the body 472 where it joins with the legs 480.

Figure 3:
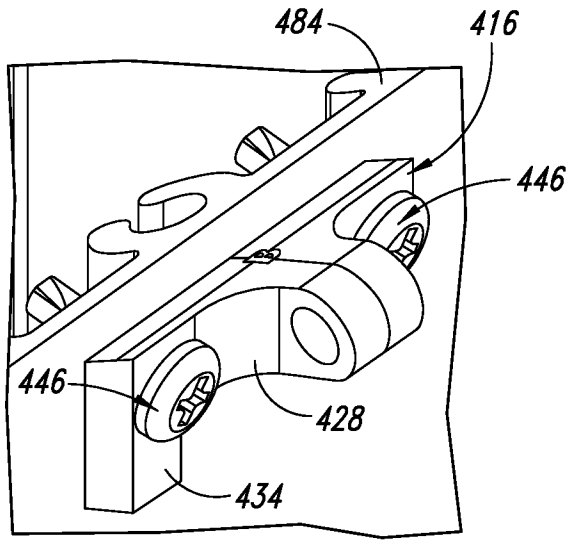
FIG. 3 is an isometric view of a first mounting block (Block B) attached to a first support post.

The assembly procedure is illustrated in FIGS. 3-8. In FIG. 3, for an elevational change in an upward direction where a top rail or railing is to be attached, the first block 416 (Block B) is selected and attached to a support structure, such as the lower post 406, using two of the self-threading fasteners 446 so that the neck 428 projects upward and away from the post 406 and the legs 434 extend downward. For bottom rail installations where the elevation change is upward, the third block 470 (Block C) is similarly attached to the support structure with the neck 474 pointing in a upward direction away from the lower post 406 and the legs 480 pointing upward.

Figure 4:
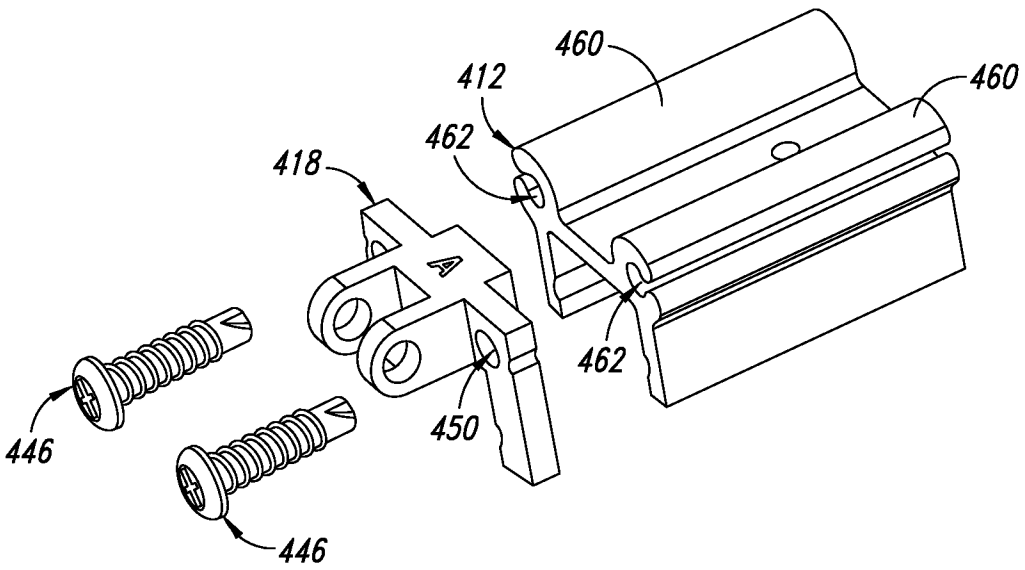
FIG. 4 is an exploded isometric view of a first rail connection block, a second mounting block (Block C), and fasteners for use with the first mounting block (Block B) in FIG. 3.

Next, as shown in the exploded view of FIG. 4, the second block 418 (Block A) is attached to the rail connection block 412 using the two fasteners 446 that pass through the openings 450 in the second mounting block 418 and into the elongate openings 462 formed in the cylindrical corners 460.

Figure 6:
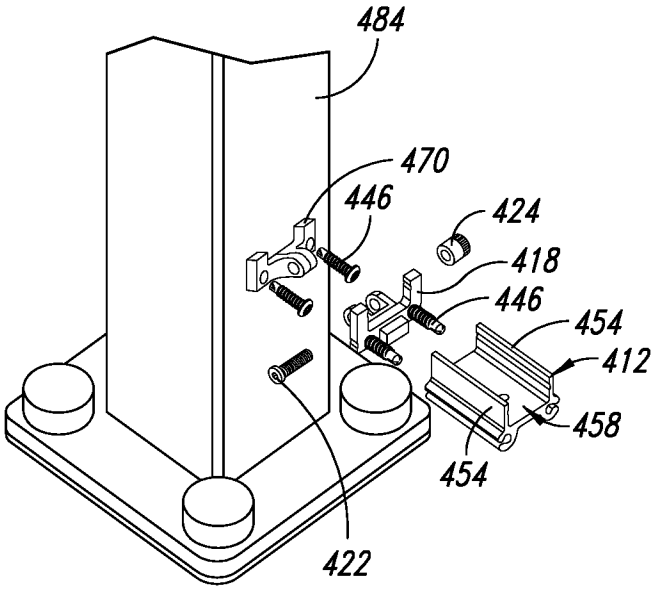
FIG. 6 is an exploded view of the rail connection assembly and support post with fasteners and hinge pin of FIG. 5.
Figure 5:
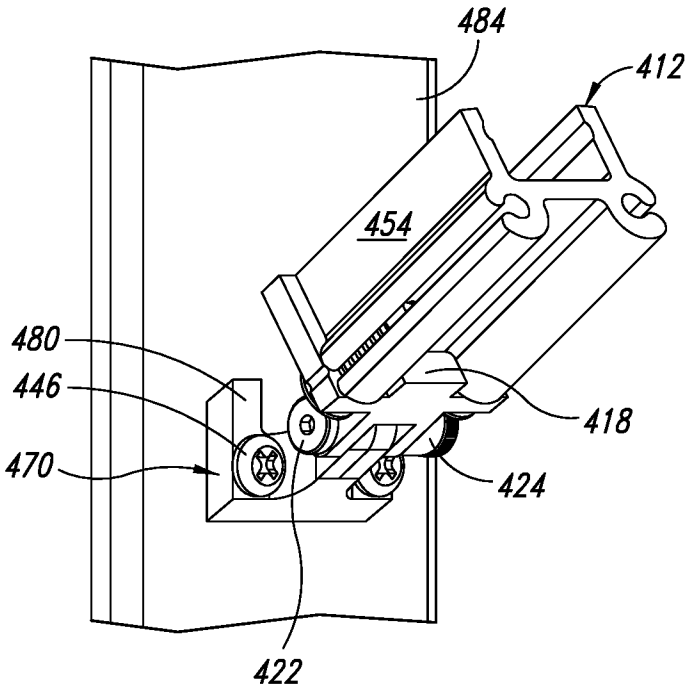
FIG. 5 is an isometric view of a rail connection assembly of FIGS. 1, 3, and 4 attached to a support post.

FIG. 5 is an exploded view of the bottom side post assembly for an upward elevation change of a lower or bottom rail (not shown) in which the third block 470 (Block C) is attached to the post 406 as described above with the legs pointing upwards. The second block 418 (Block A) is already attached to the rail connection block 412 as described above, and the assembly is inverted so that the channel 454 between the two legs 454 is facing upward. The second block 418 (Block A) and the third block 470 (Block C) are then rotatably coupled together using the socket head screw 422 and the socket nut 424 as described above. FIG. 6 shows the completed bottom side post assembly.

Figure 8:
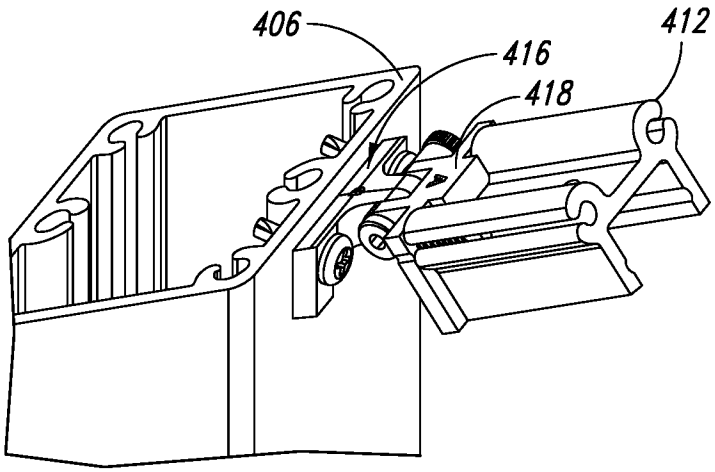
FIGS. 7 and 8 are exploded and assembled isometric views of a top rail articulated hinge assembly and associated lower support post.
Figure 7:
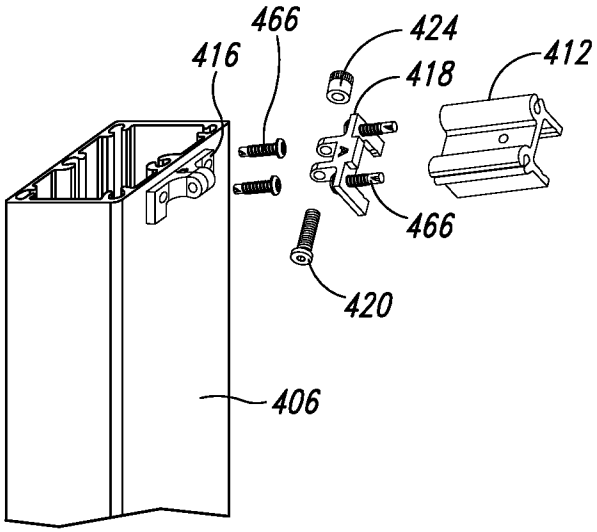
Figure 9:
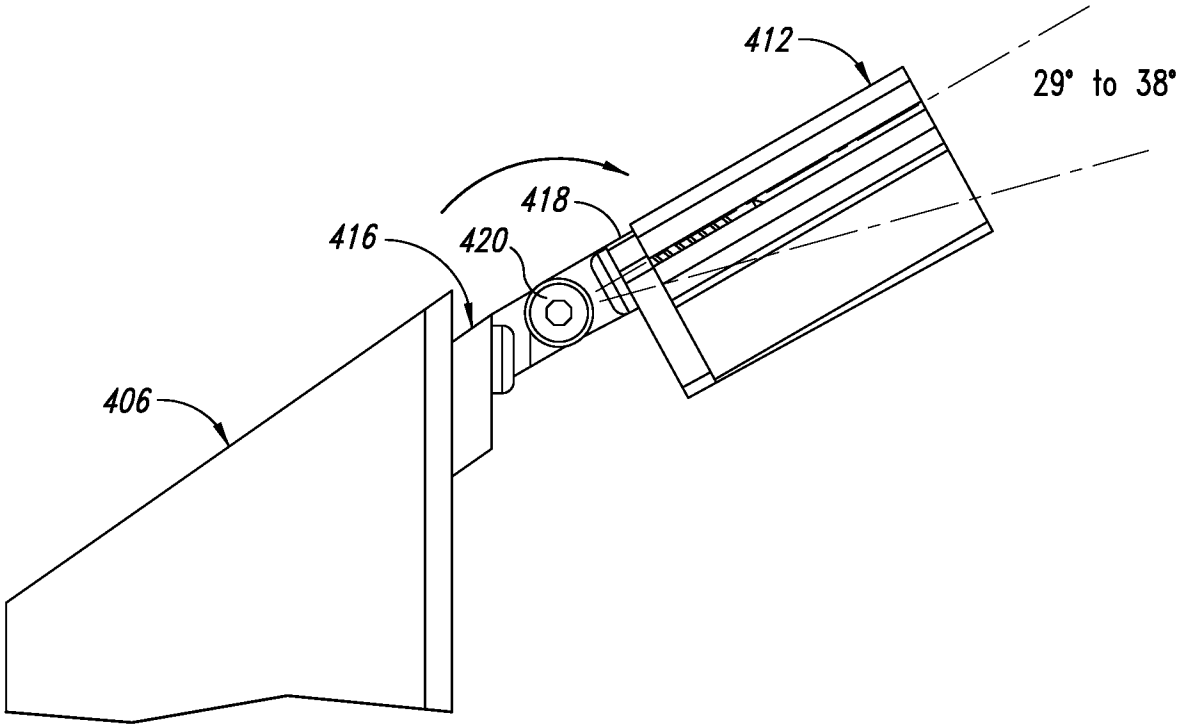
FIG. 9 is a side elevational view of the top rail articulated hinge assembly and lower support of FIGS. 7 and 8 showing the range of motion.

For the top rail installation, FIGS. 7 and 8 show the top portion of the lower post 406 with the first mounting block 416 (Block B) attached to the lower post 406, and the second mounting block 418 (Block A) attached to the rail connection block 412 and pivotally connected to the first mounting block 416 (Block B) via the hinge pin 420. The connection to the upper post 410 is done in a similar fashion, except the third mounting block 470 (Block C) is attached to the upper post 410 and pivotally connected to the second mounting block 418 (Block A) via the hinge pin 420. The range of motion provided by this implementation of the present disclosure is shown in FIG. 9, which is a side view of FIG. 8, in which the rail connection block 412 can move between the angles of 29° and 38° inclusive. Once the rail connection blocks 412 are attached to the respective posts, the bottom rail 403 or a top rail infill (not shown) will be snapped into the respective groove 468, 458.

A complete installation of the system in connection with a stairway 484 is shown in FIGS. 10A-10E. Each of the four mounting points are shown in FIGS. 10B-10E, which are enlarged, partial views in which the rail 402 is shown in phantom. As can be seen therein, the orientation of the rail connection block 412 will either be right side up for top rail 402 connections or upside down for bottom rail 403 connections. More particularly, in this implementation, each installation must have the second block 418 (Block A) at the ends 404, 408 of the top rail 402 as well as at the ends of the bottom rail 403, and first and third mounting blocks 416, 470 (Blocks B and C) at diagonal mounting areas.

When the upper and lower rails 402, 403, are attached to the respective rail connection blocks 412, they will extend past the rail connection blocks 412 to the respective post 402, 403 and cover the rail connection block 412 and related mounting blocks 416, 418, 470 and hardware, concealing them from view after installation. The constrained space of this implementation limits the amount of angular movement of the articulated assemblies 400 and their attached rails 402, 403.

A glass panel 486 is shown in this implementation, which is held in place by the upper and lower rails 402, 403 and related hardware. For the top rail 402, an infill will be snapped into the lower groove 458 on the rail connection block 412 and held in place by a self-threading fastener extending through the opening 469 in the cross piece 456 in the rail connection block 412.

It is to be understood that other forms of barriers may be used besides a glass panel, as discussed above. This and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A hidden rail mounting apparatus for use with a rail having a first end to be attached to a first support and a second end to be attached to a second support, the rail mounting apparatus comprising:

a first rail connection block sized and shaped to be attached to the first end of the rail; and a first articulated hinge assembly comprising:

a first mounting block to be attached to the first support;

a second mounting block to be attached to the first rail connection block; and a hinge pin to couple the second mounting block to the first mounting block and enable the second mounting block, the first rail connection block, and the rail to pivot together relative to the first mounting block and the first support;

the first rail connection block and first articulated hinge assembly are sized and shaped to be received within the first end of the rail to be concealed from view after installation.

2. The rail mounting apparatus of claim 1, further comprising:

a second rail connection block sized and shaped to be attached to the second end of the rail; and a second articulated hinge assembly comprising:

a first mounting block to be attached to the second support;

a second mounting block to be attached to the second rail connection block; and a hinge pin to couple the second mounting block to the first mounting block and enable the second mounting block, the second rail connection block, and the rail to pivot together relative to the second support;

the second rail connection block and second articulated hinge assembly are sized and shaped to be received within the second end of the rail to be concealed from view after installation.

3. The rail mounting apparatus of claim 2 wherein the first and second articulated hinge assemblies enable the rail to pivot relative to the first support and the second support in a range of 29 degrees to 38 degrees.

4. A railing system, comprising:

a first support and a second support;

a rail having a first end and a second end;

a first rail connection block sized and shaped to be attached to the first end of the rail; and a first articulated hinge assembly comprising:

a first mounting block to be attached to the first support;

a second mounting block to be attached to the first rail connection block; and a hinge member to couple the second mounting block to the first mounting block and enable the second mounting block, the first rail connection block, and the rail to pivot together relative to the first mounting block and the first support;

the first rail connection block and first articulated hinge assembly are sized and shaped to be received within the first end of the rail to be concealed from view after installation;

a second rail connection block sized and shaped to be attached to the second end of the rail; and a second articulated hinge assembly comprising:

a first mounting block to be attached to the second support;

a second mounting block to be attached to the second rail connection block; and a hinge member to couple the second mounting block to the first mounting block and enable the second mounting block, the second rail connection block, and the rail to pivot together relative to the second support;

the second rail connection block and second articulated hinge assembly are sized and shaped to be received within the second end of the rail to be concealed from view after installation.

5. The railing system of claim 4 wherein the first and second articulated hinge assemblies enable the rail to pivot relative to the respective first support and the second support in the range of 29 degrees to 38 degrees.

6. A system, comprising:

a first support and a second support;

a top rail having a first end, a second end, a top side, and an opposing bottom side;

a first rail connection block sized and shaped to be attached to the first end of the top rail; and a first articulated hinge assembly comprising:

a first mounting block to be attached to the first support;

a second mounting block to be attached to the first rail connection block; and a hinge member to couple the second mounting block to the first mounting block and enable the second mounting block, the first rail connection block, and the top rail to pivot together relative to the first support the first rail connection block and first articulated hinge assembly are sized and shaped to be received within the first end of the top rail to be concealed from view after installation; and a second rail connection block sized and shaped to be attached to the second end of the top rail; and a second articulated hinge assembly comprising:

a first mounting block to be attached to the second support;

a second mounting block to be attached to the second rail connection block; and a hinge member to couple the second mounting block to the first mounting block and enable the second mounting block, the second rail connection block, and the top rail to pivot together relative to the second support;

the second rail connection block and second articulated hinge assembly are sized and shaped to be received within the second end of the top rail to be concealed from view after installation.

7. The system of claim 6, further comprising:

a glass panel having a bottom edge and an opposing top edge;

a top rail infill capable of attachment to the bottom side of the top rail, the top rail infill having a channel;

a first vinyl liner sized and shaped to be received in the channel of the top rail infill and further sized and shaped to receive the top edge of the glass panel.

8. The system of claim 7, further comprising:

a bottom rail having a first end, a second end, a top side, and an opposing bottom side, the top side having a channel;

a third rail connection block sized and shaped to be attached to the first end of the bottom rail; and a third articulated hinge assembly comprising:

a first mounting block to be attached to the first support;

a second mounting block to be attached to the third rail connection block; and a hinge member to couple the second mounting block to the first mounting block and enable the second mounting block, the third rail connection block, and the bottom rail to pivot together relative to the first support;

the third rail connection block and first articulated hinge assembly are sized and shaped to be received within the first end of the bottom rail to be concealed from view after installation and a fourth rail connection block sized and shaped to be attached to the second end of the bottom rail; and a fourth articulated hinge assembly comprising:

a first mounting block to be attached to the second support;

a second mounting block to be attached to the fourth rail connection block; and a hinge member to couple the second mounting block to the first mounting block and enable the second mounting block, the fourth rail connection block, and the bottom rail to pivot together relative to the second support;

the fourth rail connection block and fourth articulated hinge assembly are sized and shaped to be received within the second end of the bottom rail to be concealed from view after installation.

9. The system of claim 8, further comprising:

a bottom rail infill capable of attachment to the channel in the top side of the bottom rail, the bottom rail infill having a channel;

a second vinyl liner sized and shaped to be received in the channel of the bottom rail infill and sized and shaped to receive the bottom edge of the glass panel.

10. A system, comprising:

a first support and a second support;

a top rail having a first end, a second end, a top side, and an opposing bottom side;

a first rail connection block sized and shaped to be attached to the first end of the top rail; and a first articulated hinge assembly comprising:

a first mounting block to be attached to the first support;

a second mounting block to be attached to the first rail connection block; and a hinge member to couple the second mounting block to the first mounting block and enable the second mounting block, the first rail connection block, and the top rail to pivot together relative to the first support; and a second rail connection block sized and shaped to be attached to the second end of the top rail;

a second articulated hinge assembly comprising:

a first mounting block to be attached to the second support;

a second mounting block to be attached to the second rail connection block; and a hinge member to couple the second mounting block to the first mounting block and enable the second mounting block, the second rail connection block, and the top rail to pivot together relative to the second support;

a glass panel having a bottom edge and an opposing top edge;

a top rail infill capable of attachment to the bottom side of the top rail, the top rail infill having a channel; and a first vinyl liner sized and shaped to be received in the channel of the top rail infill and further sized and shaped to receive the top edge of the glass panel.

11. The system of claim 10, further comprising:

a bottom rail having a first end, a second end, a top side, and an opposing bottom side, the top side having a channel;

a third rail connection block sized and shaped to be attached to the first end of the bottom rail; and a third articulated hinge assembly comprising:

a first mounting block to be attached to the first support;

a second mounting block to be attached to the third rail connection block; and a hinge member to couple the second mounting block to the first mounting block and enable the second mounting block, the third rail connection block, and the bottom rail to pivot together relative to the first support; and a fourth rail connection block sized and shaped to be attached to the second end of the bottom rail; and a fourth articulated hinge assembly comprising:

a first mounting block to be attached to the second support;

a second mounting block to be attached to the fourth rail connection block; and a hinge member to couple the second mounting block to the first mounting block and enable the second mounting block, the fourth rail connection block, and the bottom rail to pivot together relative to the second support.

12. The system of claim 11, further comprising:

a bottom rail infill capable of attachment to the channel in the top side of the bottom rail, the bottom rail infill having a channel;

a second vinyl liner sized and shaped to be received in the channel of the bottom rail infill and sized and shaped to receive the bottom edge of the glass panel.

* * * * *